US007100519B2

(12) United States Patent
Tsai

(10) Patent No.: US 7,100,519 B2
(45) Date of Patent: Sep. 5, 2006

(54) FOLDABLE TABLE WITH LONGITUDINAL MID-SUPPORT ARRANGEMENT

(75) Inventor: Frank Tsai, Taipei (TW)

(73) Assignee: Wok & Pan Ind. Inc., Guang Dong (CN)

( * ) Notice: Subject to any disclaimer, the term of this patent is extended or adjusted under 35 U.S.C. 154(b) by 218 days.

(21) Appl. No.: 10/671,393

(22) Filed: Sep. 24, 2003

(65) Prior Publication Data

US 2005/0061213 A1 Mar. 24, 2005

(51) Int. Cl.
*A47B 3/00* (2006.01)

(52) U.S. Cl. ..... 108/132

(58) Field of Classification Search ..... 108/132, 108/129, 167, 169, 168, 126, 130, 131, 166, 108/174

See application file for complete search history.

(56) References Cited

U.S. PATENT DOCUMENTS 2,474,450 A * 6/1949 Woodruff ..... 108/132
2,643,926 A * 6/1953 Pucci ..... 108/131
2,747,957 A * 5/1956 Lencioni ..... 108/36
2,784,042 A * 3/1957 Clapper ..... 108/132
3,416,468 A * 12/1968 Peterson et al. ..... 108/131
4,951,576 A * 8/1990 Cobos et al. ..... 108/131
5,217,125 A * 6/1993 Swanson ..... 211/195
5,662,298 A * 9/1997 Collins ..... 248/188.1
5,732,637 A * 3/1998 Raab ..... 108/129
5,957,061 A * 9/1999 Chang ..... 108/129
6,058,853 A * 5/2000 Pinch ..... 108/129
6,431,092 B1 * 8/2002 Stanford ..... 108/132
6,520,094 B1 * 2/2003 Wen ..... 108/132
6,615,743 B1 * 9/2003 Nien ..... 108/132
6,752,091 B1 * 6/2004 Glover et al. ..... 108/168

* cited by examiner

*Primary Examiner*—Janet M. Wilkens
*Assistant Examiner*—Timothy M Ayres
(74) *Attorney, Agent, or Firm*—Raymond Y. Chan; David & Raymond Patent Group

(57) ABSTRACT

A foldable table includes a tabletop, two side runners respectively supported at two side edge portions of the tabletop, a longitudinal mid-support arrangement including a mid-runner longitudinally extended between the two side runners to support the tabletop, and two leg assemblies affixing to the tabletop. Each leg assembly includes a leg frame transversely and pivotally mounted between the two side runners and a folding frame pivotally coupling between the leg frame and the mid-runner to retain the leg frame in an unfolded position, in such a manner that in a folded position, the leg frames are pivotally and inwardly folded to rest under the tabletop, and in the unfolded position, the leg frames are pivotally and outwardly folded to perpendicularly stand under the tabletop. Therefore, the longitudinal mid-support arrangement is adapted for evenly distributing and supporting a downward loading force on the tabletop to the leg assemblies.

10 Claims, 5 Drawing Sheets

FOLDABLE TABLE WITH LONGITUDINAL MID-SUPPORT ARRANGEMENT

BACKGROUND OF THE PRESENT INVENTION

1. Field of Invention

The present invention relates to a banquet table, and more particularly to a foldable table which comprises a longitudinal mid-support arrangement extended between two side runners for substantially enhancing the strength of the tabletop and the leg assembly in a foldably movable manner.

2. Description of Related Arts

Banquet tables have become very popular since the tables are economic, cheap and foldable that can be quickly and easily folded for carriage and storage and unfolded for use. Especially when some participant-intensive activities take place in multi-function rooms or designated areas, the banquet tables can be temporary set up in minutes. After the functions, the banquet tables can be quickly and neatly folded up for storage.

A conventional banquet table comprises a tabletop and a pair of table legs foldable mounted underneath the tabletop. For example, U.S. Pat. No. 5,957,061 generally suggests a banquet table that two table legs are pivotally mounted at two opposed side end portions of the tabletop. Since the two table legs support the tabletop at two side end portions thereof, when a downward loading force F is applied on the tabletop, a mid-portion of the tabletop may be cracked easily. In order to enhance the rigid structure of the banquet table, the tabletop must be made of a stiff material such as wood or metal. However, the wooden or metal tabletop will increase the overall weight of the banquet table that reduces the portability of the banquet table.

In order to enhance the portability of the banquet table, the tabletop is made of lightweight material such as plastic. One of the common technologies to manufacture the tabletop is known as the plastic "air-blow" molding technique. Therefore, the overall weight of the banquet table will be substantially reduced by the plastic tabletop. However, such banquet table having the plastic tabletop has several drawbacks.

The strength of such plastic tabletop is weak that the mid-portion of the plastic tabletop may be cracked easily due to the downward loading force F. As shown in FIGS. 1 and 2, U.S. Pat. No. 6,431,092 generally suggests a banquet table generally comprises a plastic made top panel 1, two metal made supporting arms 2 longitudinally mounted under the top panel 1, and a metal made reinforcing arm 3 transversely mounted below a mid-portion of the top panel 1 between the two supporting arms 2 to substantially increase the strength of the top panel 1.

In addition, in order to foldably attach the table leg 4 to the tabletop, the table leg 4 comprises a standing leg rotatably mounted between the supporting arms 2 and a folding leg pivotally mounted between the standing leg and the reinforcing arm 3 such that the standing leg is capable of pivotally folding under the top panel 1 of the tabletop. As a result, the reinforcing arm 3 not only enhances the strength of the top panel 1 but also rigidly supports the table leg 4 in a foldable manner. In other words, the plastic tabletop must include the reinforcing arm 3 in order to form the banquet table.

However, the reinforcing arm 3 restricts the pivotally attaching position of the folding leg. Since the reinforcing arm 3 is transversely mounted at the middle of the tabletop, the folding leg must be long enough to pivotally extend from the standing leg to the reinforcing arm 3, which may weaken the strength of the folding leg.

Furthermore, due to the position of the reinforcing arm 3, the tabletop cannot be modified to employ with a folding hinge at the mid-portion thereof for further overlappedly folding the tabletop in half to substantially reduce the size of the tabletop.

SUMMARY OF THE PRESENT INVENTION

A main object of the present invention is to provide a foldable table, which comprises a mid-runner longitudinally extended between two side runners for substantially enhancing the strength of the tabletop and the leg assembly in a foldably movable manner.

Another object of the present invention is to provide a foldable table, which has a rigid, simple, and strong structure to evenly distribute and support a downward loading force on the tabletop to the leg assembly through the mid-runner.

Another object of the present invention is to provide a foldable table, wherein a folding frame of the leg assembly is adapted to adjustably couple along the mid-runner to retain the leg assembly in a folded position. In other words, a length of the folding frame can be substantially shortened to couple between the standing leg and the mid-runner so as to enhance the strength of the leg assembly.

Another object of the present invention is to provide a foldable table, wherein the mid-runner provides a substantial support without altering or complicating the original structure of the foldable table.

Another object of the present invention is to provide a foldable table, wherein the mid-runner can be simply modified to incorporate with a folding hinge to overlappedly fold the tabletop so as to substantially reduce the size thereof.

Another object of the present invention is to provide a foldable table, wherein no expensive or mechanical structure is required to employ in the present invention in order to achieve the above mentioned objects. Therefore, the present invention successfully provides an economic and efficient solution not only for providing a reinforced supporting configuration to the tabletop but also for enhancing the folding movement of the leg assembly with respect to the tabletop.

Accordingly, in order to accomplish the above objects, the present invention provides a foldable table, comprising:

a tabletop having two longitudinal side edge portions;

two side runners respectively supported at the two side edge portions of the tabletop;

a longitudinal mid-support arrangement comprising a mid-runner longitudinally extended between the two side runners to support the tabletop; and a pair of leg assemblies foldably and spacedly affixing to the tabletop, wherein each of the leg assemblies comprises a leg frame transversely and pivotally mounted between the two side runners and a folding frame pivotally coupling between the leg frame and the mid-runner to retain the leg frame in an unfolded position, in such a manner that in a folded position, the leg frames are pivotally and inwardly folded to rest under the tabletop, and in the unfolded position, the leg frames are pivotally and outwardly folded to perpendicularly stand under the tabletop such that the longitudinal mid-support arrangement is adapted for evenly distributing and supporting a downward loading force on the tabletop to the leg assemblies through the mid-runner.

These and other objectives, features, and advantages of the present invention will become apparent from the following detailed description, the accompanying drawings, and the appended claims.

DETAILED DESCRIPTION OF THE PREFERRED EMBODIMENT

Figure 3:
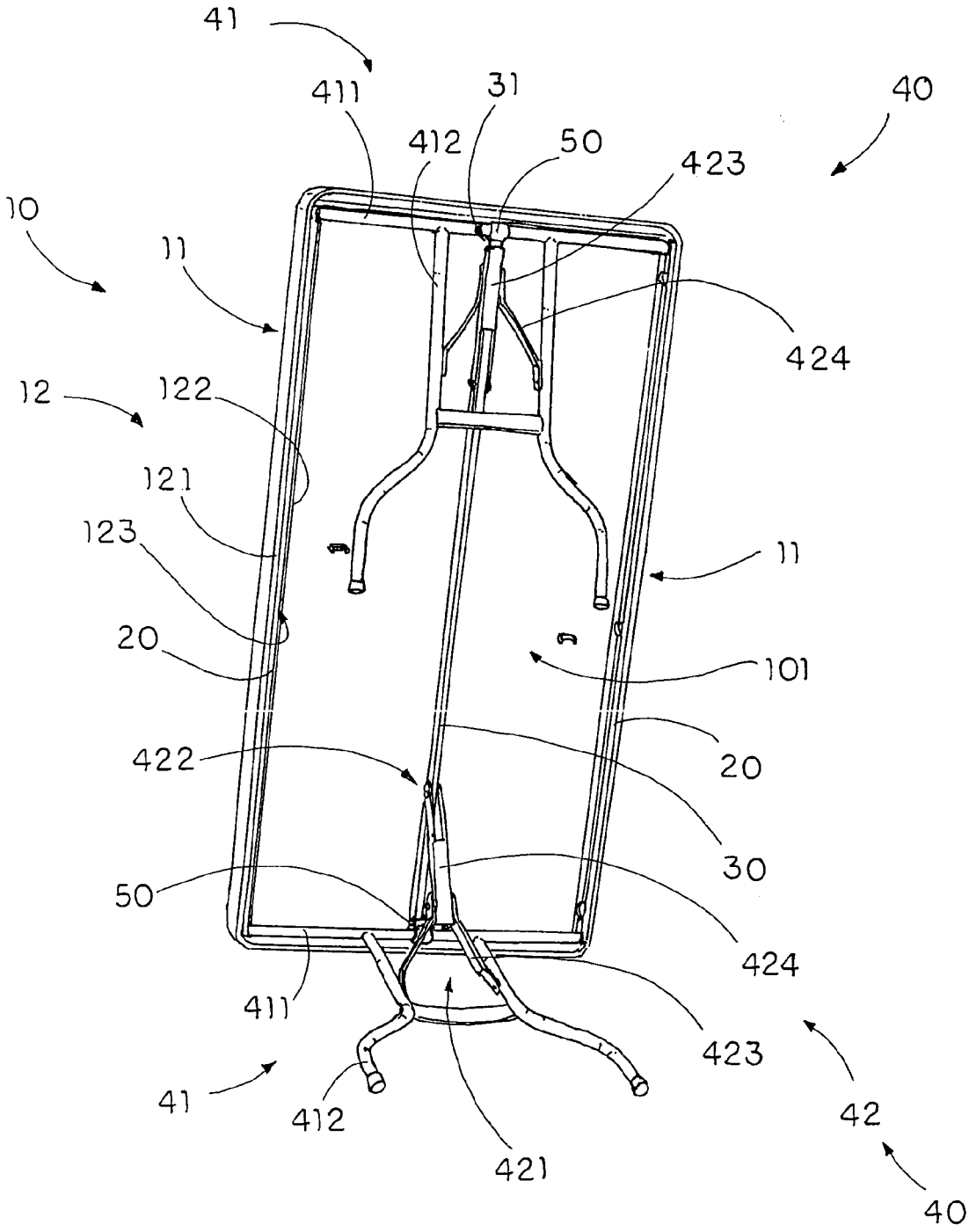
FIG. 3 is a perspective view of a foldable table according to a preferred embodiment of the present invention.

Referring to FIG. 3 of the drawings, a foldable table according to a preferred embodiment of the present invention is illustrated, wherein the foldable table comprises a plastic tabletop 10 having two longitudinal side edge portions 11, two side runners 20 respectively supported at the two side edge portions 11 of the tabletop 10, and longitudinal mid-support arrangement comprising a mid-runner 30 extended between the two side runners 20 to support the tabletop 10.

The foldable table further comprises a pair of leg assemblies 40 foldably and spacedly affixing to the tabletop 10, wherein each of the leg assemblies 40 comprises a leg frame 41 transversely and pivotally mounted between the two side runners 20 and a folding frame 42 pivotally coupling between the leg frame 41 and the mid-runner 30 to retain the leg frame 41 in an unfolded position. In which, in a folded position, the leg frames 41 are pivotally and inwardly folded to rest under the tabletop 10, and in the unfolded position, the leg frames 41 are pivotally and outwardly folded to perpendicularly stand under the tabletop 10 such that the longitudinal mid-support arrangement is adapted for evenly distributing and supporting a downward loading force F on the tabletop 10 to the leg assemblies 40 through the mid-runner 30.

According to the preferred embodiment, the tabletop 10 is a single layer tabletop preferably made of lightweight but rigid material, such as plastic, by plastic molding or FRP. It is worth to mention that the tabletop 10 can be a double-layer tabletop that a top layer is overlapped on a bottom layer to define an air chamber therebetween.

The tabletop 10, having a rectangular shaped, defines a surrounding rim 12 downwardly extended from each of the side edge portions 11 of the tabletop 10 to define a receiving cavity 101 within the surrounding rim 12 at a bottom side of the tabletop 10 such that each of the foldable pivot leg assemblies 40 is adapted to foldably receive within the receiving cavity 101 of the tabletop 10 at the folded position.

As shown in FIG. 3, the surrounding rim 12 has an outer sidewall 121 and an inner sidewall 122 to define a receiving track 123 longitudinally formed under the tabletop 10 along the respective side edge portion 11 thereof wherein the two side runners 20 are securely mounted within the receiving tracks 123 respectively.

Each of the side runners 20, which is made of rigid material such as metal, is an elongated member extended from one side end portion of the tabletop 10 to another opposed side end portion thereof at a longitudinal mi-portion of the tabletop 10, so as to substantially enhance the rigid structure of the tabletop 10.

As shown in FIG. 3, the mid-runner 30 is extended between the two side runners 20 in a parallel manner at a position underneath the tabletop 10 for further enhance the rigid structure of the tabletop 10 at a longitudinal mid-portion thereof, wherein the mid-runner 30 is substantially extended between the two leg assemblies 40 so as to reinforce the two leg assemblies 40.

According to the preferred embodiment, each of the leg frames 41 comprises a transverse member 411 rotatably extended between the two side runners 20 and a supporting leg 412 downwardly extended from the transverse member 411 in such a manner that each of the two supporting legs 412 is adapted to pivotally fold between the folded position and the unfolded position. Accordingly, each of the transverse members 411 has two ends rotatably engaged with the two side runners 20 respectively wherein the two transverse members 411 are transversely extended along two transverse side edge portions of the tabletop 10 respectively so as to enhance the strength of the tabletop 10.

Each of the folding frames 42 has a leg coupling end 421 pivotally coupling with the respective leg frame 41 and a table coupling end 422 pivotally and selectively coupling along the mid-runner 30 such that when the leg frames 41 are outwardly and pivotally folded, each of the folding frames 42 limits a pivot movement of the respective leg frame 41 with respect to the mid-runner 30 so as to retain the respective leg frame 41 at the unfolded position.

Each of the folding frames 42 comprises a folding brace 423 defining the leg coupling end 421 to pivotally connect to supporting leg 421 of the leg frame 41 and a folding arm 424 which is pivotally connected to the folding brace 423 and defines the table coupling end 422 to pivotally connect to the mid-runner 30 such that when the leg frames 41 are inwardly and pivotally folded to the folded position, the folding braces 423 are pivotally folded to overlap with the folding arms 424 respectively. In other words, the folding brace 423 is pivotally folded with respect to the folding arm 424 to extend a distance between the leg coupling end 421 of the folding frame 42 and the table coupling end 422 thereof so as to retain the respective leg frame 41 at the unfolded position.

Figure 5:
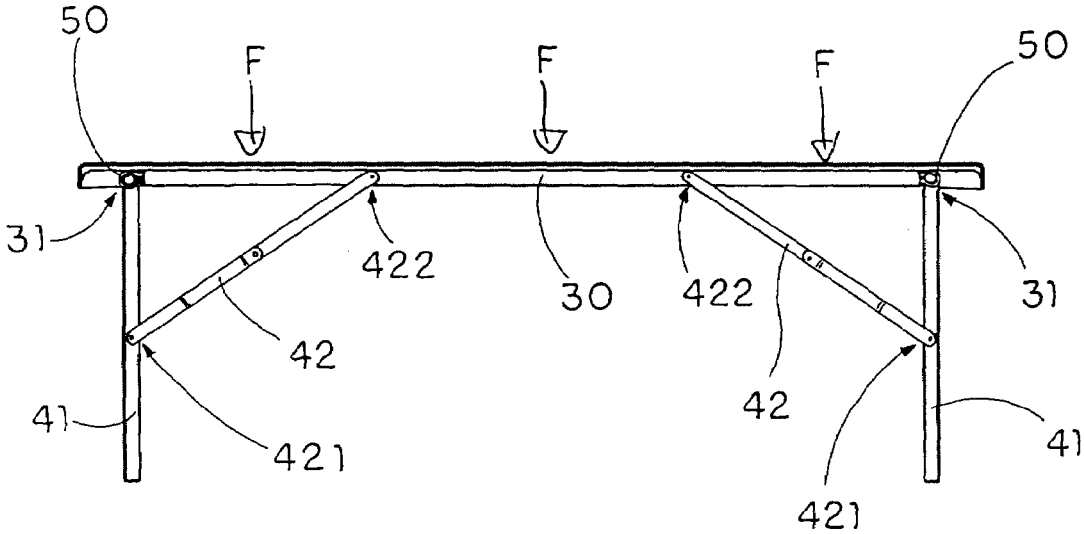
FIG. 5 is a sectional view of the foldable table according to the above preferred embodiment of the present invention, illustrating the downward loading force applying on the tabletop of the foldable table.

It is worth to mention that the table coupling end 422 of the respective folding frame 42 can be adjustably coupled with the mid-runner 30 at any position between the two transverse members 411 of the leg frames 41 depending on the length of the tabletop 10 such that the tabletop 10 can rigidly support a greater downward loading force F thereon in comparison with the conventional foldable table since the mid-runner 30 of the longitudinal mid-support arrangement not only substantially supports the tabletop 10 but also evenly distributes the downward loading force F to the leg assemblies 40, as shown in FIG. 5. In other words, each of the folding frames 42 does not need to pivotally extend from the respective leg frame 41 to a mid-portion of the tabletop 10 so as to substantially enhance the rigid configuration of the folding frame 42.

Figure 4:
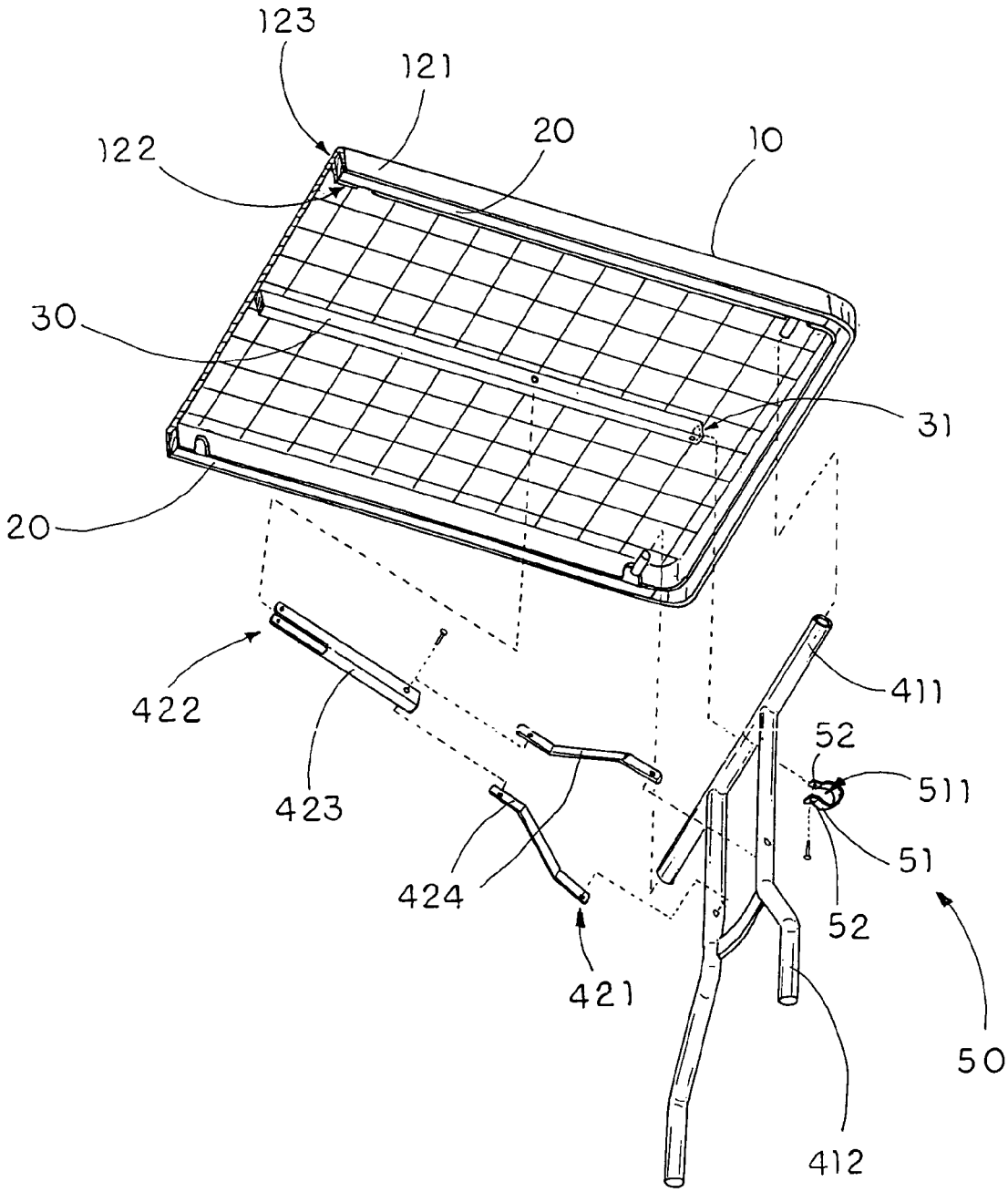
FIG. 4 is an exploded perspective view of an attachment unit of the foldable table according to the above preferred embodiment of the present invention.

As shown in FIG. 4, the mid-runner 30 has two ends 31 extended to respectively couple with the two leg frames 41 and enables the leg frames 41 to rotate with respect to the mid-runner 30. Accordingly, the foldable table further comprises two attachment units 50 rotatably connecting the leg frames 41 with the two ends 31 of the mid-runner 30 respectively wherein each of the attachment units 50 comprises a C-shaped frame holder 51 having a guiding slot 511 for the respective transverse member 411 rotatably passing through and a frame connector 52 extended from the frame holder 51 to securely attach to the respective end 31 of the mid-runner 30 via a rivet or a screw in such a manner that the transverse members 411 of the leg frames 41 are rotatably connected to the ends 31 of the mid-runner 30.

It is apparent that the attachment unit 50 can be replaced by other connecting arrangements which connect the respective end 31 of the mid-runner 30 with the transverse member 411 of the respective leg frame 41 such that the transverse member 411 is allowed to support under the tabletop 10 in a rotatably movable manner with respect to the mid-runner 30.

It is worth to mention that two or more mid-runners 30 can be employed to parallelly extend between the two side runners 20 wherein the table coupling end 422 of the folding frame 42 is adapted for pivotally coupling with the two mid-runners 30 to guide the leg frame 41 to fold between the folded position and the unfolded position.

Preferably, the mid-runner 30 is supported underneath the tabletop 10 by connecting the two ends 31 of the mid-runner 30 to the transverse members 411 of the leg frame 41 respectively so as to retain the mid-runner 30 in position. Therefore, the downward loading force F applied on the tabletop 10 can be evenly distributed and supported to the entire leg assemblies 40, i.e. the leg frames 41 and the folding frames 42, through the mid-runner 30 of the longitudinal mid-support arrangement.

Figure 1:
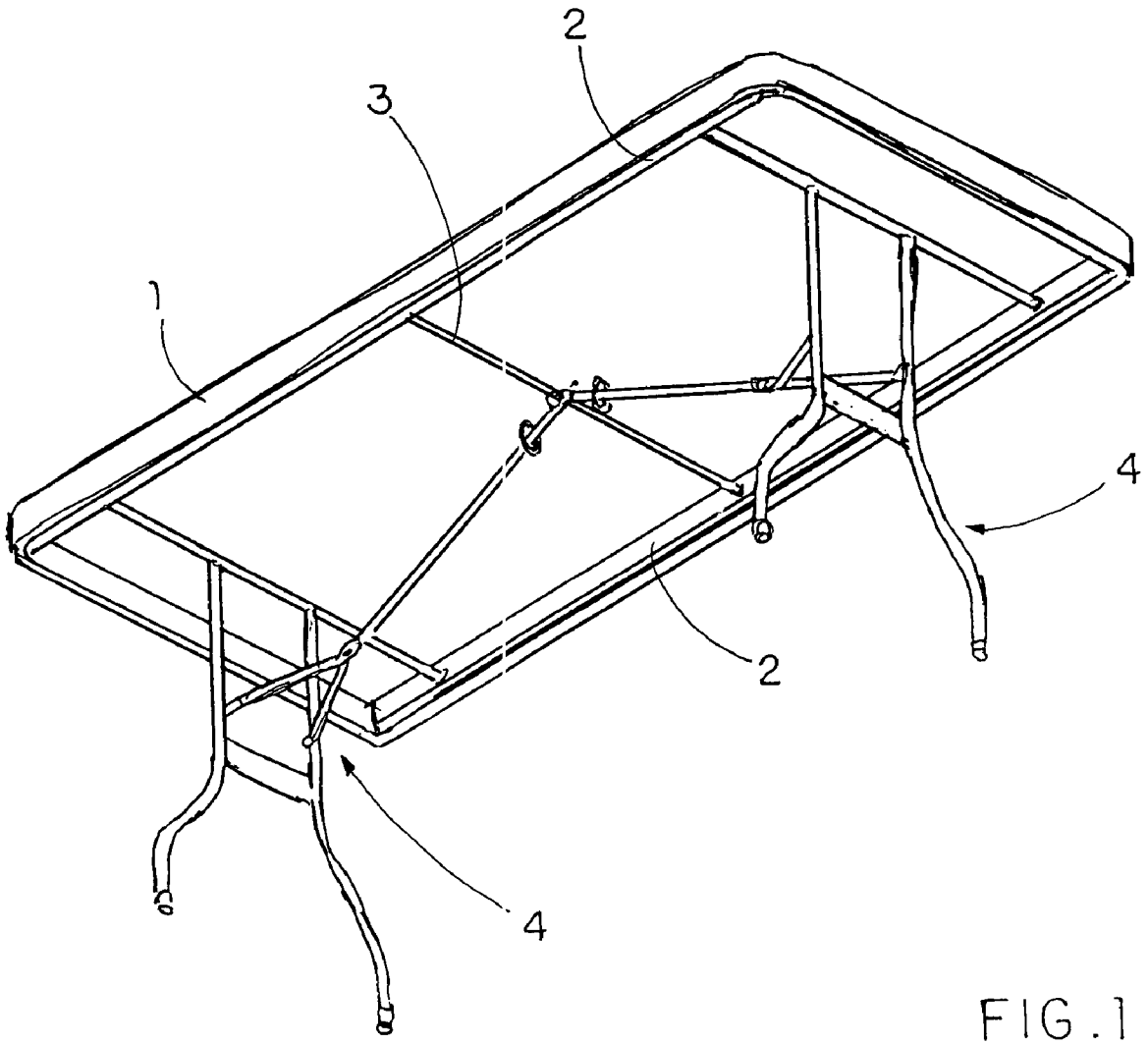
FIG. 1 PRIOR ART
FIG. 1 is a perspective view of a conventional foldable table.
Figure 2:
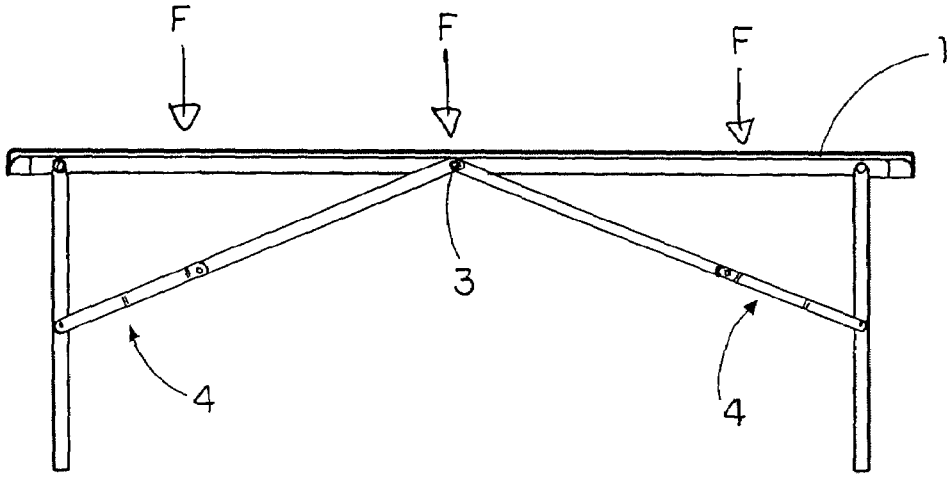
FIG. 2 PRIOR ART
FIG. 2 is a sectional view of the conventional foldable table, illustrating the downward loading force applying on the tabletop of the conventional foldable table.

In other words, the foldable table of the present invention, as shown in FIG. 5, has a rigid, simple, and strong structure to evenly distribute and support the downward loading force F on the tabletop 10 to the leg assemblies 40 through the mid-runner 30 in comparison with the conventional foldable table as shown in FIG. 2.

It is worth to mention that the mid-runner 30 is adapted to directly and securely mount underneath the tabletop 10 to retain the position of the mid-runner 30 wherein the ends 31 of the mid-runner 30 is extended towards the two leg frames 31 between the two side runners 20 such that no attachment unit 50 is required to connect the mid-runner 30 with the leg frames 41. However, the mid-runner 30 can still enhance the strength of the tabletop 10 and reinforce the leg assemblies 40.

Figure 6:
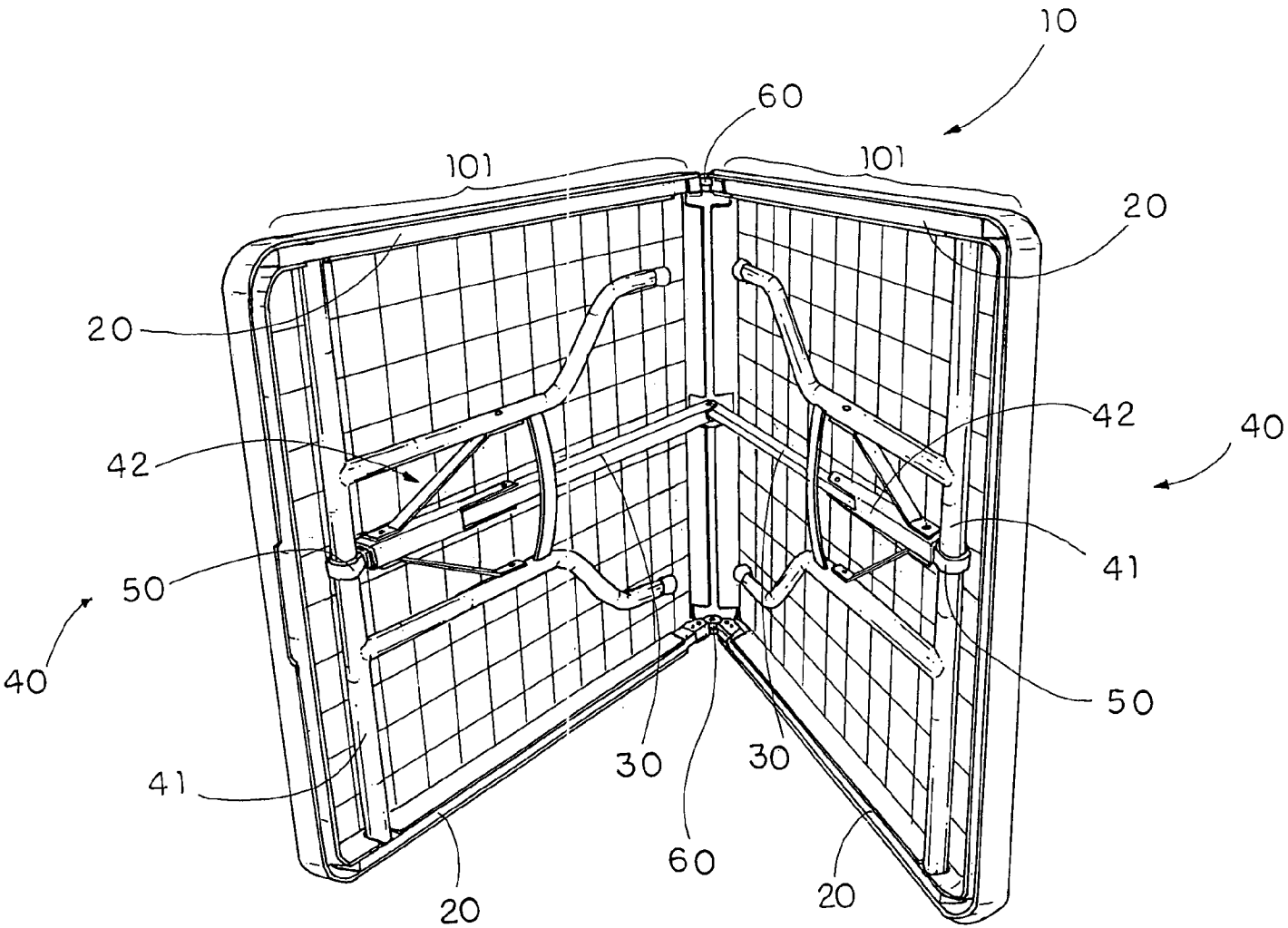
FIG. 6 illustrates the foldable table incorporating with a folding hinge according to the above preferred embodiment of the present invention.

As shown in FIG. 6, the foldable table according to the preferred embodiment can be further modified to further reduce the overall size thereof by overlappedly folding the tabletop 10 in half. Accordingly, the tabletop 10, which is constructed to have two side panels 101, comprises a pivot hinge 60 formed at a mid-portion of each of the side runners 20 between the two side panels 101, wherein the mid-runner 30 has two longitudinal portion pivotally connected end to end in such a manner that the side panels 101 are adapted to fold in an overlapped manner via the pivot hinge 60 to reduce the size of the tabletop 10. It is worth to mention that an additional pivot hinge can be employed to pivotally connect the longitudinal portions of the mid-runner 30 so as to enhance the folding movement of the tabletop 10.

Therefore, the foldable table of the present invention can be simply modified to incorporate with the pivot hinges 60 without altering or complicating the original structure of the foldable table in comparison with the conventional foldable table that the reinforcing arm is transversely extended at a mid-portion of the tabletop.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A foldable table, comprising:

a tabletop having two longitudinal side edge portions;

two side runners respectively supported underneath said tabletop at said two side edge portions thereof;

a pair of leg assemblies foldably and spacedly affixing to said tabletop, wherein each of said leg assemblies comprises a leg frame transversely and pivotally mounted between said two side runners and a folding frame pivotally coupling with said respective leg frame to retain said leg frame at an unfolded position, wherein at a folded position, said leg frames are pivotally and inwardly folded to rest under said tabletop, and at said unfolded position, said leg frames are pivotally and outwardly folded to perpendicularly stand under said tabletop;

a mid-runner having two ends coupling with said two leg frames respectively to retain said mid-runner at a position that said mid-runner is longitudinally extended under said tabletop between said two side runners, wherein said folding frame is pivotally coupled between said leg frame and said mid-runner such that when said leg frames are folded at said unfolded position, said mid-runner is adapted for evenly distributing and supporting a downward loading force on said tabletop to said leg assemblies through said mid-runner, wherein each of said leg frames comprises a transverse member rotatably extended between said two side runners and a supporting legs downwardly extended from said transverse member, wherein said two ends of said mid-runner are respectively coupling with said transverse members to retain said mid-runner in position between said two side runners; and two attachment units rotatably connecting said transverse members of said leg frames with said two ends of said mid-runner respectively, wherein each of said attachment units comprises a C-shaped frame holder having a guiding slot for said respective transverse member rotatably passing through and a frame connector extended from said frame holder to securely attach to said respective end of said mid-runner.

2. The foldable table, as recited in claim 1, wherein said tabletop has two receiving tracks longitudinally and integrally formed along said two side edge portions of said tabletop respectively, wherein said two side runners are securely received in said receiving tracks respectively so as to retain said side runners in position.

3. The foldable table, as recited in claim 2, wherein said tabletop has a surrounding rim downwardly extended from each of said side edge portions of said tabletop to define a receiving cavity within said surrounding rim at a bottom side of said tabletop, wherein said foldable pivot leg assemblies are foldably received within said receiving cavity of said tabletop at said folded position.

4. The foldable table, as recited in claim 3, wherein said surrounding rim has an outer sidewall and an inner sidewall to form said respective receiving track longitudinally extended under said respective side edge portion of said tabletop to receive said respective side runner so as to retain said side runner in position.

5. The foldable table, as recited in claim 4, wherein said mid-runner is extended between said two side runners in a parallel manner to support said tabletop.

6. The foldable table, as recited in claim 5, wherein each of said folding frames has a leg coupling end pivotally coupling with said respective leg frame and a table coupling end pivotally and selectively coupling along said mid-runner such that when said leg frames are outwardly and pivotally folded, each of said folding frames limits a pivot movement of said respective leg frame with respect to said mid-runner so as to retain said respective leg frame at said unfolded position.

7. The foldable table, as recited in claim 6, wherein said tabletop comprises two side panels and a pivot hinge which is positioned between said two side panels and is formed at a mid-portion of each of said side runners between said two side panels, wherein said mid-runner has two longitudinal portions pivotally connected end-to-end to align with said two pivot hinges in such a manner that said side panels are adapted to fold in an overlapped manner via said pivot hinges for reduce a size of said tabletop.

8. The foldable table, as recited in claim 1, wherein said mid-runner is extended between said two side runners in a parallel manner to support said tabletop.

9. The foldable table, as recited in claim 2, wherein each of said folding frames has a leg coupling end pivotally coupling with said respective leg frame and a table coupling end pivotally and selectively coupling along said mid-runner such that when said leg frames are outwardly and pivotally folded, each of said folding frames limits a pivot movement of said respective leg frame with respect to said mid-runner so as to retain said respective leg frame at said unfolded position.

10. The foldable table, as recited in claim 9, wherein said tabletop comprises two side panels and a pivot hinge which is positioned between said two side panels and is formed at a mid-portion of each of said side runners between said two side panels, wherein said mid-runner has two longitudinal portions pivotally connected end-to-end to align with said two pivot hinges in such a manner that said side panels are adapted to fold in an overlapped manner via said pivot hinges for reduce a size of said tabletop.

* * * * *